US006607692B2

(12) United States Patent
Beal

(10) Patent No.: US 6,607,692 B2
(45) **Date of Patent: *Aug. 19, 2003**

(54) METHOD OF MANUFACTURE OF A POWDER-BASED FIREARM AMMUNITION PROJECTILE EMPLOYING ELECTROSTATIC CHARGE

(75) Inventor: Harold F. Beal, Rockford, TN (US)

(73) Assignee: Doris Nebel Beal Intervivos Patent Trust, Pawleys Island, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/038,801

(22) Filed: Dec. 31, 2001

(65) Prior Publication Data

US 2002/0134197 A1 Sep. 26, 2002

Related U.S. Application Data

(63) Continuation-in-part of application No. 09/198,823, filed on Nov. 24, 1998, now Pat. No. 6,457,417, which is a continuation-in-part of application No. 08/922,129, filed on Aug. 28, 1997, now Pat. No. 5,847,313, which is a continuation-in-part of application No. 08/792,578, filed on Jan. 30, 1997, now Pat. No. 5,789,698.

(60) Provisional application No. 60/259,566, filed on Jan. 3, 2001.

(51) Int. Cl.[7] ..... B22F 3/02; F42B 12/74

(52) U.S. Cl. ..... 419/65; 75/252; 102/517

(58) Field of Search ..... 419/65; 102/517; 75/252

(56) References Cited

U.S. PATENT DOCUMENTS

| | | | |
|---|---|---|---|
| 290,738 | A | 12/1883 | Brown |
| 1,732,211 | A | 10/1929 | Olin et al. |
| 1,992,244 | A | 2/1935 | Schuricht |
| 2,393,648 | A | 1/1946 | Martin |
| 3,209,691 | A | 10/1965 | Herter |

(List continued on next page.)

FOREIGN PATENT DOCUMENTS

| | | |
|---|---|---|
| CZ | 80541 | 6/1951 |
| FR | 374726 | 7/1907 |
| GB | 538268 | 7/1941 |
| GB | 861718 | 2/1961 |
| GB | 2278423 | 11/1994 |
| GE | 57101 | 1/1913 |
| GE | 1116575 | 11/1961 |
| GE | 38 35 808 | 4/1990 |
| IT | 349795 | 9/1937 |
| WO | WO 96/01407 | 1/1996 |

OTHER PUBLICATIONS

Lyman—Reloading Handbook for Rifle, Pistol, and Muzzle Loading—45th edition.

*Primary Examiner*—Daniel J. Jenkins
(74) *Attorney, Agent, or Firm*—Pitts & Brittian, P.C.

(57) ABSTRACT

A first metal powder having a density greater than the density of lead is mixed with a second metal powder having a density not greater than the density of lead and a matrix micronized polymeric powder which is itself a poor electrical conductor but susceptible to accumulation of an electrostatic charge thereon during handling and/or transportation thereof. The mixing of these metal powders and the micronized polymeric powder is performed under conditions which maintain, promote or enhance the electrostatic environment within a mixing vessel with the result that the metal and nonmetal powders become substantially uniformly distributed throughout the mixture, and retain their uniform distribution after removal from the mixing vessel, and carry forward such uniform distribution into and throughout subsequent conversion of the mixture into ammunition projectiles without the heavy and light metal powder particulates separating, according to their respective densities, into semi-layers or strata.

20 Claims, 3 Drawing Sheets

U.S. PATENT DOCUMENTS

| | | | | | |
|---|---|---|---|---|---|
| 3,349,711 | A | | 10/1967 | Darigo et al. | |
| 3,720,170 | A | | 3/1973 | Godfrey | |
| 3,888,636 | A | | 6/1975 | Sczerzenie et al. | |
| 4,387,492 | A | | 6/1983 | Inman | |
| 4,428,295 | A | | 1/1984 | Urs | |
| 4,498,395 | A | | 2/1985 | Kock et al. | |
| 4,644,865 | A | | 2/1987 | lawrence | |
| 4,753,172 | A | | 6/1988 | Katzmann et al. | |
| 4,895,077 | A | | 1/1990 | Miethlich et al. | |
| 4,940,404 | A | | 7/1990 | Ammon et al. | |
| 4,958,572 | A | | 9/1990 | Martel | |
| 4,970,960 | A | | 11/1990 | Feldmann | |
| 5,033,356 | A | | 7/1991 | Richardson | |
| 5,035,183 | A | | 7/1991 | Luxton | |
| 5,604,462 | A | | 11/1991 | Mullendore | |
| 5,078,054 | A | | 1/1992 | Ashok et al. | |
| 5,079,814 | A | | 1/1992 | Moore et al. | |
| 5,189,252 | A | | 2/1993 | Huffman et al. | |
| 5,198,616 | A | | 3/1993 | Anderson | |
| 5,261,941 | A | | 11/1993 | Sheinberg | |
| 5,264,022 | A | | 11/1993 | Haygarth et al. | |
| 5,275,108 | A | | 1/1994 | Chernicky et al. | |
| 5,279,787 | A | | 1/1994 | Oltrogge | |
| 5,293,822 | A | | 3/1994 | Peddie | |
| 5,325,787 | A | | 7/1994 | Boual | |
| 5,399,187 | A | | 3/1995 | Mravic et al. | |
| 5,527,376 | A | | 6/1996 | Amick et al. | |
| 5,594,186 | A | | 1/1997 | Krause et al. | |
| 5,597,975 | A | | 1/1997 | Satow | |
| 5,719,352 | A | | 2/1998 | Griffin | |
| 5,789,698 | A | * | 8/1998 | Beal | 102/516 |
| 5,847,313 | A | * | 12/1998 | Beal | 102/516 |
| 6,048,379 | A | | 4/2000 | Bray et al. | |
| 6,457,417 | B1 | * | 10/2002 | Beal | 102/517 |

* cited by examiner

METHOD OF MANUFACTURE OF A POWDER-BASED FIREARM AMMUNITION PROJECTILE EMPLOYING ELECTROSTATIC CHARGE

RELATED APPLICATIONS

This application is a non-provisional application based on Provisional Application Serial No. 60/259,566, filed Jan. 3, 2001, entitled: METHOD FOR THE MANUFACTURE OF A POWDER-BASED FIREARM AMMUNITION PROJECTILE EMPLOYING ELECTROSTATIC CHARGE, and is a continuation-in-part of application of Ser. No. 09/198,823, filed Nov. 24, 1998, now U.S. Pat. No. 6,457,417 entitled: METHOD FOR THE MANUFACTURE OF A FRANGIBLE NONSINTERED POWDER-BASED PROJECTILE FOR USE IN GUN AMMUNITION AND PRODUCT OBTAINED THEREBY; which is a continuation-in-part of Ser. No. 08/922,129, filed Aug. 28, 1997, entitled: PROJECTILE FOR AMMUNITION CARTRIDGE (now U.S. Pat. No. 5,847,313) (which is a continuation-in-part of Ser. No. 08/792,578, filed Jan. 30, 1997, now U.S. Pat. No. 5,789,698 entitled: PROJECTILE FOR AMMUNITION CARTRIDGE); Ser. No. 08/843,450, filed Apr. 16, 1997, entitled: SMALL BORE FRANGIBLE AMMUNITION PROJECTILE (abandoned); Ser. No. 08/842,635, filed Apr. 16, 1997, entitled: AMMUNITION PROJECTILE AND METHOD FOR MAKING SAME (abandoned); Ser. No. 08/888,270, Filed Jul. 3, 1997, entitled: PLATED PROJECTILE FOR USE IN SUBSONIC AMMUNITION FOR SMALL-BORE SEMI-AUTOMATIC OR AUTOMATIC WEAPONS AND METHOD FOR MAKING SAME (abandoned) ((which is a continuation in part of application Ser. No. 08/843,450, filed Apr. 16, 1897, entitled: SMALL BORE FRANGIBLE AMMUNITION PROJECTILE (abandoned), and Serial No. 08,815,003, filed Mar. 14, 1997, entitled: SUBSONIC AMMUNITION, now U.S. Pat. No. 5,822,904, issued Oct. 20, 1998)); and Ser. No. 08/887,774, filed Jul. 3, 1997, entitled: JACKETED PROJECTILE FOR USE IN SUBSONIC AMMUNITION FOR SMALL-BORE SEMI-AUTOMATIC OR AUTOMATIC WEAPONS AND METHOD FOR MAKING SAME (abandoned)(which is a continuation in part of Ser. Nos. 08/843,450 and 08/815,003 which are referenced hereinabove). Priority is claimed based upon the foregoing referenced applications, and each of the foregoing applications in its entirety is incorporated herein by reference.

FIELD OF INVENTION

This invention relates to methods of making a firearm ammunition projectile from metal powders. "Powder-based" as used herein refers to projectiles comprising metal powders as opposed to shaped solid metal or metal alloys, the latter being excluded as a part of the present invention.

BACKGROUND OF INVENTION

"Green" firearm ammunition projectiles generally comprise projectiles which do not include lead as a component of the projectile. In recent years lead has been identified as a "pollutant" and has been banned from much of the firearm ammunition projectiles. As a substitute for lead projectiles, projectiles formed from a combination of various metals, particularly, metal powders, have been developed. Commonly, tungsten metal powder is mixed with tin, zinc, bismuth, or other metal powder, the mixture is die-formed into individual cores which are subsequently loaded into a metal jacket. The leading end of the metal jacket, containing one or more cores is closed by defining an ogive on such leading end.

One major problem with powder-based (i.e. non-lead containing) projectiles relates to the non-uniformity of the density distribution of the powders which go to make up the projectile. First, it is to be noted that powder-based projectiles desirably provide at least the same performance when fired to a target as do lead projectiles, and, in certain instances, produce like recoil values when the projectile is fired from a weapon. Second, non-uniformity of density of the projectile, at least about the longitudinal centerline of the projectile, (a) reduces the accuracy of delivery of the projectile to a target, (b) reduces the ballistics coefficient of the projectile, (c) imparts nutation to the fired projectile thereby limiting its range of travel from a firearm, among other things. This problem of non-uniformity of density of the core and/or the resultant projectile, is exacerbated when using two or more metal powders, of different densities, in a mixture thereof, for forming a projectile. More specifically, for example, mixtures of tungsten powder and tin, zinc, bismuth or like metal powder, for example, tend to separate, by gravity, into layers of the relative heavy tungsten powder and of the relatively lighter metal powder, by reason of the difference in their respective densities. Such separation may occur in the course of mixing the metal powders together, in transferring of portions of the mixture between containers, in transferring of portions (aliquots) of the mixture into a die, in movement of the mixture from location to location or even during storage (i.e., any vibration of the mixture) and/or in the course of die-forming of the portions of the metal powders into a core which is subsequently encapsulated in a metal, e.g. copper, jacket.

Bare, i.e. non-jacketed, projectiles containing tungsten powder are unacceptable for use in small-bore weapons, particularly those weapons having rifled barrels. The exposed tungsten powder in the non-jacketed projectile is severely abrasive and quickly erodes and renders ineffective the barrel of the weapon. Moreover, individual particles of the tungsten tend to break away from the projectile and enter the mechanism of the weapon, again rendering the weapon ineffective, and often completely useless. This latter factor is particularly a problem with semi-automatic and/or automatic weapons in that the tungsten particles migrate into the bolt-actuating mechanism of these weapons to the extent that the weapon fails to function.

In the course of loading a die-formed core into a metal jacket, it is commonly required that the core be pressed into the jacket to ensure complete filling of the jacket by the core. Also, it is common to die-form an ogive on the leading end of the jacket and core container therein. Each of these manufacturing operations tends to disrupt the powder-based core and further at least partially destroy whatever uniformity of density the core may have at the time it is removed from its forming die.

It is an object, therefore, of the present invention to provide a method of making a firearm ammunition projectile employing a mixture of relatively heavy and relatively light metal powders which are substantially uniformly distributed through the projectile.

SUMMARY OF INVENTION

In accordance with one embodiment of the method of the present invention, a first metal powder having a density greater than the density of lead is mixed with a second metal powder having a density not greater than the density of lead to provide a mixture of these powders. In accordance with one aspect of the present invention, there is simultaneously mixed with these metal powders a matrix micronized polymeric powder which is itself a poor electrical conductor but very susceptible to accumulation of an electrostatic charge during handling and/or transportation thereof. The mixing of these metal powders and the micronized polymeric powder is performed under conditions which maintain, promote or enhance the electrostatic environment within a blender, for example, with the result that the mixed metal and non-metal powders become substantially uniformly distributed throughout the mixture, and retain their uniform distribution after removal from the blender. In accordance with a further aspect of the present invention, this uniformity of distribution of the powder particles within the mixture carries forward into and throughout subsequent conversion of the mixture into ammunition projectiles without the heavy and light metal powder particulates separating, according to their respective densities, into semi-layers or strata, even when vibrated in the course of transfer of the mixed powders from the blender to a storage container, during the storage of the mixture, and/or during subsequent manufacturing steps involving the mixture.

In one embodiment of the present invention, the metal powders are admixed in a laboratory "V"-blender having a shell formed of a polymeric material, e.g., an acrylic polymer in a preferred embodiment. In one embodiment of the present invention, the micronized polymeric powder itself possesses an electrostatic charge at the time it is admitted to the blender. Normally, the metal powders do not exhibit an electrostatic charge at the time these powders are admitted to the blender. Through observation the inventor has discovered that when the metal powder particles are mixed with the micronized polymeric powder in the blender having a polymeric, preferably acrylic, shell, an electrostatic charge exists within the blender. It appears that in some manner this electrostatic charge within the blender effects uniform distribution of the heavy and light metal powder particles irrespective of their relative densities in the course of the mixing process. Moreover, this mixing process has been observed to enhance any electrostatic charge initially carried by the micronized polymeric powder, presumably the movement of the polymeric powder particles relative to one another and/or relative to the polymeric shell of the blender. operation imparted to at least the metal powder particulates.

DETAILED DESCRIPTION OF INVENTION

Figure 1:
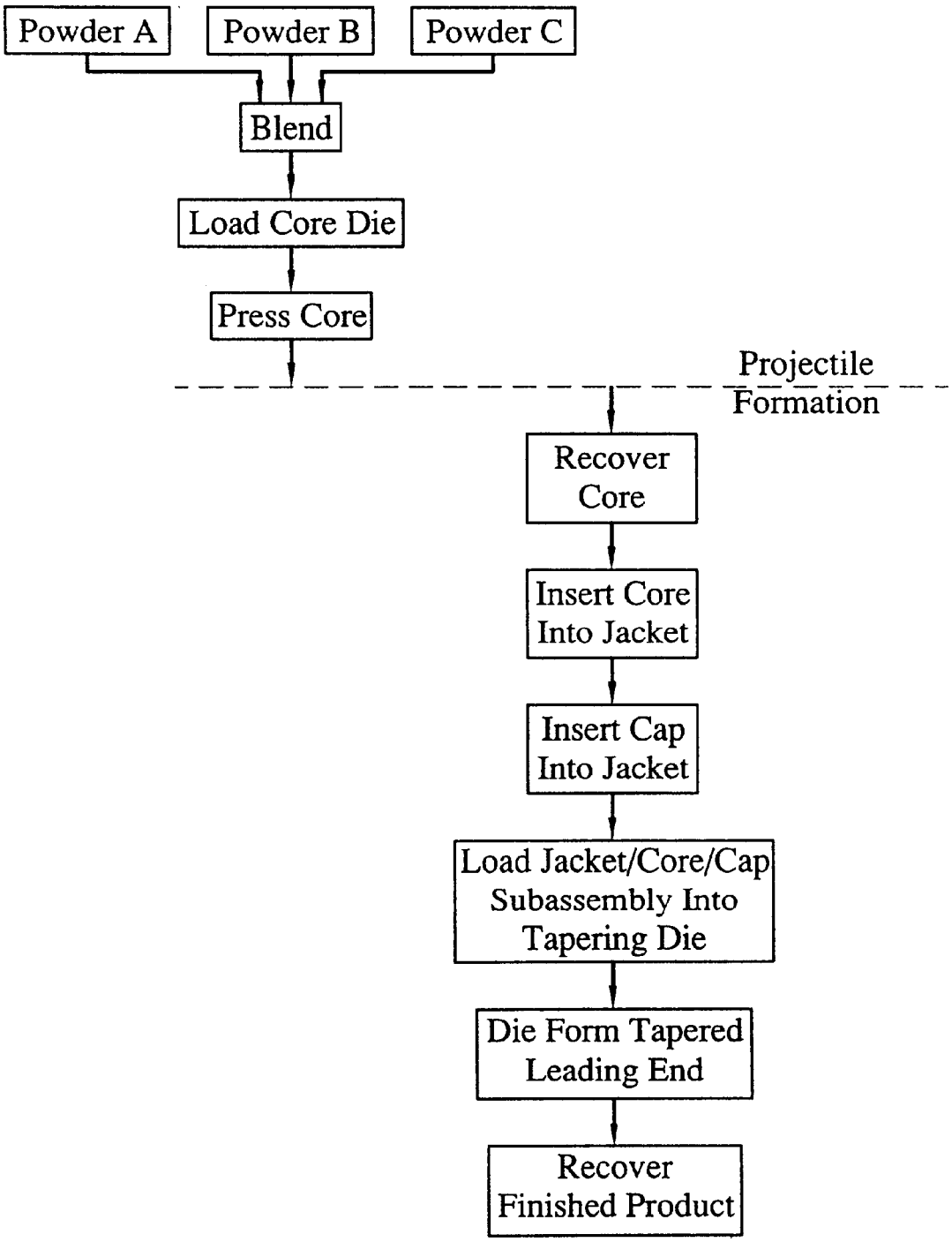
FIG. 1 is a schematic diagram depicting the steps of one embodiment of the method of the present invention.

Referring initially to FIG. 1, one embodiment of the method of the present invention comprises the steps of (a) selecting a quantity of a metal powder (A) having a density greater than the density of lead, (b) selecting a quantity of a metal powder (B) having a density not greater than the density of lead, (c) selecting a nonmetal, electrically conductive, matrix micronized polymeric powder (C), and, (d) mixing the selected quantities of the two metal powders and the micronized polymeric powder in a blender preferably having a polymeric shell. As also depicted in FIG. 1, the incorporation of the mixture into a firearm ammunition projectile may include the further steps of (e) forming individual quantities of the mixed powders into individual cores suitable for the receipt thereof in respective elongated cup-shaped metal jackets, (f) loading, preferably with pressing, a core into the jacket, (g) closing the open end of the jacket, preferably employing a die having a cavity which is suitable for the forming of an ogive at the open (leading) end of the jacket, thereby forming a firearm ammunition projectile of a density which is at least uniformly distributed radially about the longitudinal axis of the completed projectile, and (h) recovery of the finished projectile.

Figure 3:
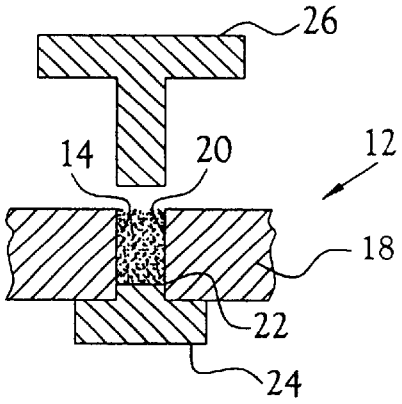
FIG. 3 is a schematic representation of one embodiment of apparatus employed for die-forming a core in accordance with one aspect of the present invention
Figure 4:
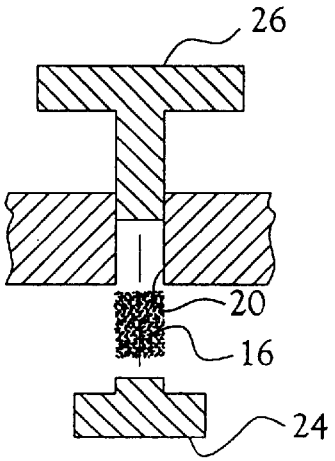
FIG. 4 is a further schematic representation of the apparatus depicted in FIG. 3 and showing a cold-pressed core following its removal from a forming die.

FIGS. 3 and 4 schematically depict one embodiment of a die 12 for cold-pressing an aliquot 14 of the powder mixture into a self-supporting core 16 (see FIG. 4). The depicted die 12 includes a die body 18 defining a die cavity 20 adapted to receive therein an aliquot of the powder mixture. The bottom end 22 of the die cavity is closed by a first punch 24. A second punch 26 is provided for insertion into the die cavity to compact the aliquot of powder into a core. After formation of the core, the second punch is withdrawn (see FIG. 4) and the second punch is activated to push the pressed core out of the die.

Figure 2:
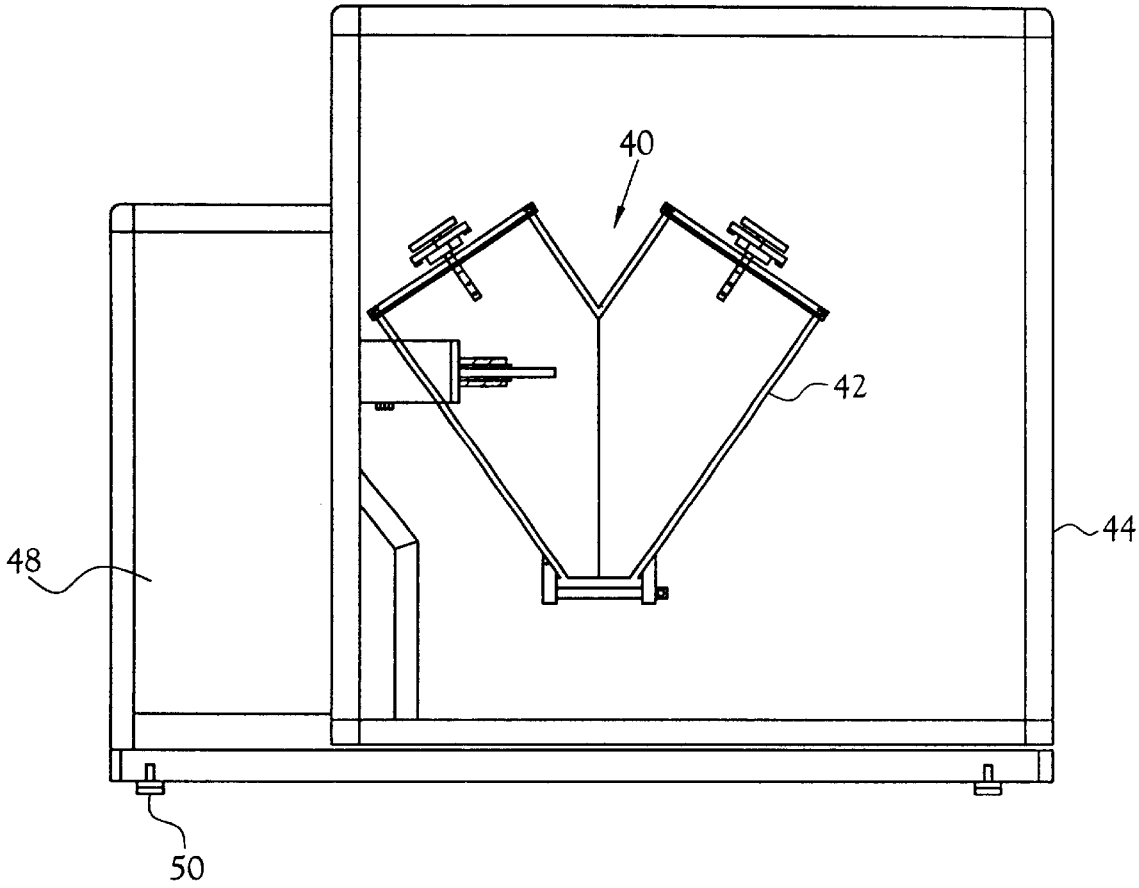
FIG. 2 is a schematic representation of one embodiment of apparatus employed in the mixing of metal powders in accordance with one aspect of the method of the present invention.

FIG. 2 depicts one suitable blender for use in the mixing the powders in accordance with the present invention. Preferably, the blender 40 employed in the present invention comprises a "V" shaped blender having a shell 42 of a polymeric, e.g. acrylic resin, material for a time sufficient to uniformly mix the metal powders and the polymeric powder into a mixture of substantially uniformly distributed metal and non-metal powder particles. The depicted blender comprises a frame 44 which rotatably supports the "V" shaped shell 42 therein. Rotation of the shell is effected by a motor (not shown) contained within a housing 48 also supported by the frame, as is well known in the art. Notably, the frame is electrically isolated as by insulative feet 50 (typical), such as rubber cushions.

Whereas the mechanism or mechanisms by which the uniformity of distribution of the two or more metal powders having different densities is initially developed and subsequently maintained during manufacturing operations is unknown with certainty, it has been found that in the absence of an electrostatic charge within the blender, when the mixture of removed from the blender, the heavy and light metal powders will deleteriously separate, by gravity according to their respective densities, into at least semi-layers strata of heavy metal powder and light metal powder. The magnitude of the electrostatic charge is known to be relatively small in that no physical "electrical shock or sparking" can be detected upon grounding of a quantity of the mixed powders. On the other hand, the powder mixture of the present invention exhibits clear indications of electrostatic interaction and/or a combination of electrostatic interaction and mechanical interaction between the particulates of the metal powders and the particulates of the micronized polymeric powder in that the powders remain physically associated with neighboring particulates of the mixture and the metal powders do not separate in accordance to their respective densities in the course of ordinary handling of the mixture, such as when transferring the mixture from the blender to a storage vessel, storage of the mixture, and/or aliquoting of the mixture into forming dies. The presence of an electrostatic charge associated with the powders within the blender may be seen by merely inserting one's hand and/or forearm into the blender containing the mixed powders. When an electrostatic charge is present, the hairs on the hand and/or forearm will extend as is common in the presence of an electrostatic field.

Even though the precise mechanism or mechanisms by which the observed results are produced in accordance with the present invention, the present inventor has determined that the presence of an electrostatic environment with the blender is a prerequisite to the success of the present invention. For example, mixing only the two metal powders, and excluding the micronized polymeric powder, produces a mixture of the metal powders which will separate, by gravity, into at least semi-layers or strata of heavy metal powder particles and light metal powder particles, irrespective of the material of construction of the blender.

It is known that a micronized polyethylene powder commonly develops an electrostatic charge during handling and transportation. This electrostatic charge is retained by the powder for a relatively long time, e.g. weeks or months unless electrically grounded. The magnitude of such charge, however, may vary very widely. Moreover, such micronized polymeric powder may take on a lessor or greater electrostatic charge as a function of the humidity, temperature, and/or other atmospheric conditions and/or mechanical movement to which the powder is exposed. In the present invention the metal powders and micronized polymeric powder are stored prior to mixing, and are mixed, at convention room temperature, e.g., about 70° F. at a relative humidity of between about 50% and 70%. It has been found by the present inventor that under certain atmospheric conditions, e.g., relative high humidity at room temperature, one an employ a blender having a metallic shell, as opposed to a polymeric shell, in combination with the described non-metal micronized polymeric powder, and obtain a mixture of the metal powders (and the polymeric powder) which exhibits an electrostatic field after mixing. It is believed, therefore, that one can impart to, or enhance the strength of, an electrostatic field to the polymeric powder prior to introduction of the powder into the blender. Alternatively, it is believed that an electrostatic charge may be imposed on the powders of the mixture in the course of the mixing operation, such as through the use of a Tesla coil or the like that is electrically connected with the mixture within the blender, whether the shell be of a metal or polymeric material. Notably, the presence of the non-metal matrix micronized polymer powder affords advantages other than those advantages associated with the presence of an electrostatic charge on the polymer powder particulates. For example, it has been found that the polymeric matrix powder enhances the pourability of the mixture, particularly with respect to the introduction of the powder mixture into a die cavity. Further, the presence of the polymeric matrix powder in the mixture has been found useful in reducing the pressure required to die press the powder mixture, at room temperature, into a self-supporting core. Accordingly, the polymeric matrix powder serves multiple functions in the course of the manufacture of a powder-based core. Still further, the presence of the polymeric matrix powder has been found to enhance the frangibility of the projectile formed from the mixture, when fired into a solid or semi-solid target. Other advantages arising by reason of the presence of the polymeric matrix powder in the mixture have been noted. Accordingly, in a preferred embodiment, the micronized polymer powder is retained with the mixture and carried over into the completed projectile. Thus, no sintering of the powder mixture either during or after die-pressing of the mixture into a self-supporting compact is required and is to be avoided.

In one example employing the method of the present invention, eight lbs. of tungsten metal powder having a particle size of about 325 mesh and two lbs. of tin metal powder having a particle size of about 325 mesh and about one-hundredth of one percent (0.01%) of the total weight of the tungsten and tin powders, of a micronized oxidized polyethylene powder having an average particle size of about 12 microns, were introduced into a ten pound capacity P-K Blend Master® Lab Blender, manufactured by Patterson-Kelley of East Stroudsburg, Pa., and having a polymeric shell. The density of the micronized polyethylene powder was about 0.99 g/cc so that it will be recognized that the percentage by weight of the micronized polyethylene powder was minuscule compared to the percentage by weight of the tungsten and/or tin powder and would be expected to have no material effect on the density distribution of the mixture of metal powders. Nonetheless, it has been found that the presence of this very small amount of the micronized polyethylene powder, in combination with the mixing of the three powders in a blender having inner walls of a polymeric, e.g. acrylic resin, material, imparted to the mixture the ability of resisting separation of the two metal powders into semi-layers or strata according to their respective densities. As presently known, this phenomenon occurs consistently when the mixing of the powders is carried out in a blender which is electrically insulated from electrical ground, as by means of rubber feet or the like, and which has a shell which is either fabricated preferably of a polymeric material, such as an acrylic material, or which has its inner walls formed of such a polymeric material.

In accordance with a further aspect of the present invention, it has been found that the quantity of micronized polymeric powder provided in the mixture of metal powders and non-metal powder preferably is between about 0.01% and 1.5%, by weight, of the total weight of the metal powders within the mixture. Lessor amounts of the micronized polymeric powder fail to produce and/or maintain the desired uniformity of distribution of the metal powders within the mixture. Amounts of micronized polymeric powder greater than about 1.5%, by weight, produce mixtures which are unsuitable for being die-pressed into self-supporting compacts at room temperature. As employed herein, "micronized" refers to the average particle size of the individual powder particles a powdered material. A suitable micronized polymeric powder for use in the present invention comprises polymeric powder particles having an average particle size of between about 5 and about 18 microns. A suitable polymeric powder for use in the present invention comprises a micronized oxidized polyolefin, and preferably polyethylene.

Employing the P-K Blend Master® blender, fitted with a acrylic shell and having a capacity of about ten pounds, the present inventor blended a mixture of tungsten metal powder (about 80% by wt.), tin metal powder (about 20% by wt.), and a micronized oxidized polyethylene matrix powder (about 0.1% by wt.) for about thirty minutes at room temperature and a relative humidity of between about 30% and 40%. The blender was rotated at a speed of about 25 rpm (nominal).

The mixture of powders of this example was transferred from the blender into a storage vessel where it remained pending its use. In due course, the mixture was aliquoted into one or more die cavities and cold-pressed into a self-supporting core at room temperature. Preferably the pressed core has a crush strength of at least 2 Mpa and not greater than about 35 Mpa. Following removal of the core from the die, it was inserted into the open end of a cup-shaped copper metal jacket. The core was pressed into the jacket employing a punch entering the open end of the jacket. Thereafter the punch was withdrawn and the open end of the core-containing jacket was inserted into a die cavity having a geometry suitable for the formation of an ogive at the leading (open) end of the jacket and pressed into the die cavity thereby forming an ogive and at least substantially closing the open end of the jacket.

Multiple ones of the projectiles formed by the method of the present invention were loaded into ammunition cartridges which were subsequently fired from a firearm. The observed accuracy of delivery of the projectile to the target, its ballistics coefficient, and its effective range were noted to be appreciably enhanced over projectiles fired under essentially identical conditions, but which did not include the non-metal micronized polymeric powder.

In accordance with another aspect of the present invention, it has been also found that the presence of the electrostatic charge exhibited by the powder mixture at the time it exited the blender has the further effect of enhancing the frangibility of the projectile into powder particulates upon impact with a target.

Figure 5:
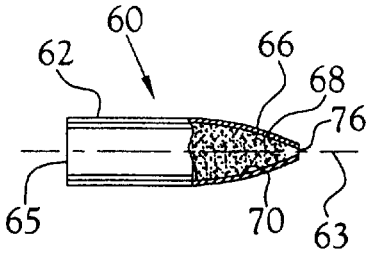
FIG. 5 is a representation, partly in section, of one embodiment of a firearm ammunition projectile produced by the method of the present invention.

One embodiment of a projectile 60 manufactured in accordance with the present invention is depicted in FIG. 5 and comprises a cup-shaped jacket 62 having a longitudinal centerline 63, a closed end 65 and a leading end 64 which is substantially closed and defines an ogive 66. A core 68 made in accordance with the method of the present invention is encapsulated in the jacket and pressed into intimate engagement with the inner wall 70 of the jacket adjacent the closed end thereof. Thereafter, the open (leading) end of the core-containing jacket is placed in a die and die-formed to define the ogive at the leading end of the projectile as is known in the art.

In one embodiment, the closed end of the jacket, with the core disposed therein, may be initially die-formed to define an ogive and thereafter the open end of the jacket may be partly or fully closed to capture the core within the jacket. Commonly the jacket is formed of copper metal which also serves a lubricative function between the rifle barrel and the projectile.

Cores for projectiles of various caliber firearms may be made employing the method of the present invention, particularly 50 caliber and smaller firearms. The cores may be formed from various combinations of metal powders and various weight percentages of each of the metal powders. For example, in the method of the present invention, tungsten powder may be employed in weight percentages of between about 10% to about 99%. Other heavy metal powders such as uranium, tantalum, or combinations of such metal powders or their carbides may be employed. Similarly, tin, zinc, bismuth, aluminum, copper and/or combinations of these lighter metal powders, in amounts from 90% to about 3%, by wt., may be employed. In all instances, between about 0.01% and about 1.5%, by wt. of a micronized polyethylene non-metal powder, such as Acumist 12 available from Allied Signal Advanced Materials of Morristown, N.J., or like non-metal micronized polymeric powder, need be included in the mixture.

Whereas the present invention has been described in considerable detail for purposes of teaching one skilled in the art how to carry out the invention, it will be recognized by such person skilled in the art that the concepts of the present invention may be carried out employing not significantly different apparatus and/or operational parameters. Optionally, the method may include additional steps, depending upon the desired characteristics of the resultant projectile, such as the incorporation of additional components, such as a cap at the leading end, and internally of, the jacket. Further, multiple cores may be included within a single jacket. Other modifications and alternatives will be recognized by one skilled in the art.

What is claimed:

1. A method of producing a mixture of at least two metal powders comprising the steps of introducing into a mixing vessel a first metal powder having a density greater than the density of lead, introducing into said mixing vessel a second metal powder having a density not greater than the density of lead;

introducing into said mixing vessel a micronized polymeric powder;

mixing said powders within said mixing vessel in an electrostatic environment for a time sufficient to produce a mixture within which at least said first and second metal powders are substantially uniformly mixed throughout said mixture and stabilized against separation of said first and second metal powders, by gravity, as a function of their respective densities.

2. The method of claim 1 wherein at least said first and second metal powders of said mixture do not separate into semi-layers or strata subsequent to the removal of said mixture from said mixing vessel and during subsequent manufacturing operations directed to the die pressing of aliquots of said mixture into self-supporting compacts.

3. The method of claim 1 wherein said micronized polymeric powder carries an electrostatic charge.

4. The method of claim 1 wherein said micronized polymeric powder comprises a polyolefin powder.

5. The method of claim 4 wherein said micronized polyolefin powder comprises micronized polyethylene powder.

6. The method of claim 1 wherein said micronized polymeric powder is present in said mixture at a quantity of between about 0.01% and about 1.5%, by weight, based upon the total weight of said first and second metal powders.

7. The method of claim 6 wherein said micronized polymeric powder is present in said mixture at a quantity of not greater than 1.5% and not less than 0.01%, by weight, based upon the total weight of said first and second powders.

8. The method of claim 1 wherein said powders are mixed in a "V" blender.

9. The method of claim 1 wherein said micronized polymeric powder comprises micronized oxidized polyethylene powder having an average particle size of between about 6 and about 18 microns.

10. The method of claim 9 wherein said micronized polymeric powder is of an average particle size of about 12 microns.

11. The method of claim 9 wherein said micronized polymeric powder has a density of about 0.99 g/cc.

12. The method of claim 9 wherein said micronized polymeric powder carries an electrostatic charge at least while in said mixing vessel.

13. The method of claim 2 wherein said micronized polymeric powder remains within said mixture throughout the conversion of aliquots of said mixture into one or more die-pressed self-supporting compacts.

14. A method of producing a powder-based core for a gun ammunition projectile comprising the steps of introducing into a mixing vessel a first metal powder having a density greater than the density of lead, introducing into said mixing vessel a second metal powder having a density not greater than the density of lead;

introducing into said mixing vessel a micronized polymeric powder;

mixing said powders within said mixing vessel in an electrostatic environment for a time sufficient to produce a mixture within which at least said first and second metal powders are substantially uniformly mixed throughout said mixture and stabilized against separation of said first and second metal powders, by gravity, as a function of their respective densities, dividing said mixture into individual aliquots and die-pressed each of said aliquots, at room temperature and without removal of said micronized polymeric powder from said mixture, into individual self-supporting compacts.

15. The method of claim 14 wherein said first metal powder is chosen from a group comprising tungsten, uranium, tantalum, or carbides thereof, and/or combinations thereof, and said second metal powder is chosen from a group comprising tin, zinc, magnesium, iron, copper, bismuth or combinations or alloys thereof.

16. The method of claim 14 wherein said micronized polymeric powder comprises polyethylene powder having a density of about 0.99 g/cc and an average particle size of about 12 microns.

17. The method of claim 14 wherein said micronized polymeric powder is present in said mixture at between 0.01% and 1.5%, by weight, based upon the total weight of said first and second metal powders present in said mixture.

18. A powder mixture suitable for conversion by die-pressing at room temperature into a self=supporting core for a projectile for gun ammunition comprising a first metal powder having a density greater than the density of lead, a second metal powder having a density not greater than the density of lead, and a micronized polymeric powder carrying an electrostatic charge, at least said metal powders being substantially uniformly distributed throughout said mixture and stabilized against separation thereof, by gravity and as a function their respective densities, during conversion of said mixture into individual die-pressed cores at room temperature.

19. The mixture of claim 18 wherein said first metal powder is tungsten, said second metal powder is tin or zinc, and said micronized polymeric powder is polyethylene powder having a density of about 0.99 g/cc and an average particle size of about 12 microns.

20. The mixture of claim 19 wherein said polyethylene powder is present in said mixture at a quantity of between 0.01% and 1.5%, by weight, based on the total weight said first and second metal powders within said mixture.

* * * * *